United States Patent [19]

Rotrekl et al.

[11] Patent Number: 4,458,728

[45] Date of Patent: Jul. 10, 1984

[54] CONSTANT TENSION LET-OFF MOTION FOR WARP THREADS IN A LOOM

[75] Inventors: Otto Rotrekl, Brno; Vladimir Kuda, Blasovice, both of Czechoslovakia

[73] Assignee: Vyzkumny a vyvojovy ustav zavodu vseobecneho strojirenstvi, Brno, Czechoslovakia

[21] Appl. No.: 539,616

[22] Filed: Oct. 6, 1983

Related U.S. Application Data

[63] Continuation-in-part of Ser. No. 247,646, Mar. 26, 1981, abandoned.

[30] Foreign Application Priority Data

Mar. 31, 1980 [CS] Czechoslovakia ..... 2217-80

[51] Int. Cl.[3] ..... D03D 49/06

[52] U.S. Cl. ..... 139/110

[58] Field of Search ..... 139/105, 109, 110; 66/211; 226/24, 30, 42; 242/75

[56] References Cited

U.S. PATENT DOCUMENTS 3,630,239 12/1971 Hooper ..... 139/110
4,058,143 11/1977 Henzl et al. ..... 139/110
4,402,347 9/1983 Rotrekl et al. ..... 139/110
4,411,293 10/1983 Santucci ..... 139/110

*Primary Examiner*—Henry Jaudon

[57] ABSTRACT

Let-off motion for elongated material wound on a let-off beam. Such let-off motion comprises a tension detector connected to the input of a let-off element, the output of which is connected with the control element of the driven let-off unit, with the input shaft of the drive and output shaft of the let-off drive, which responds to changes of the control magnitude value in its control element by a change of the relation of angular velocities between the input and output shafts. The input of the let-off element is a rotary disc slidably arranged between two axially arranged clutch discs of the let-off element, the clutch discs being mutually positively rotatable in opposite directions. The clutch discs of the let-off element are drive-coupled with the input shaft of the driven let-off unit, and the disc of the let-off element is provided with a central, internally threaded hole which receives and is threadedly mated with the threads on the spindle of the let-off element. The spindle is mounted slidably but non-rotatably in the body of the let-off element, and creates the output of the let-off motion let-off element.

9 Claims, 5 Drawing Figures

CONSTANT TENSION LET-OFF MOTION FOR WARP THREADS IN A LOOM

This application is a continuation-in-part of application Ser. No. 247,646, filed Mar. 26, 1981 , now abandoned.

This application relates to an improvement in a constant tension let-off motion for positively letting-off threads, especially warp threads in a loom.

There are machines in which it is necessary to rewind a flexible material from one beam onto another under a condition of constant tension of the flexible material. The problem of maintaining constant tension in the material being rewound is especially important with looms. In a loom the warp threads are stored on a warp beam from which they are positively let-off. The interlacing of the weft threads with the warp threads in the loom results in the formation of a fabric which is drawn by a take-up beam toward the cloth winding beam, the so-called cloth beam. It is not easy to maintain constant optimum tension in the warp threads because the length of the warp threads relatively shortens due to weft interlacing, and because the diameter of the package of warp threads on the warp beam constantly changes and thus the let-off speed of the warp threads changes. There are still other unfavorable effects caused by the rhythmical formation of the shed, etc.

It is therefore necessary to control the let-off speed of the warp threads according to increasing and decreasing tensions in them. Mechanisms used in looms are let-off motions wherein the tension detector is a back-rest, i.e. a cylinder or a roller on a spring loaded lever, while the main element of the let-off motion is usually a driven let-off unit, frequently in the form of a belt-type, infinitely variable drive (PIV). The input shaft of the PIV is usually driven from the main shaft of the loom and the out-put shaft of the PIV drives the warp beam through transmission gearing. Due to the change of the control magnitude value being fed from the detector into the control element, the PIV responds by changing the relation between the angular velocities of its input and output shafts. In such let-off motions, the detector, i.e., the back-rest, responds to the change of tension in the warp by changing its position, and the infinitely variable drive responds by changing the speed of let-off of the warp threads. Once changed, these factors remain constant until a subsequent change in warp tension occurs, and then the change in the relation in the angular velocities of the input and output shafts of the PIV changes proportionately, that is, changes in a manner which is dependent upon such change in warp thread tension. Let-off motions of this type have the disadvantage of not fully correcting deviations in warp thread tension from the set-up or predetermined optimum value. When such deviation occurs by reason of the decreasing diameter of the warp thread package on the warp beam in the course of weaving, there can result more frequent warp thread breakage and a consequent worsening of the quality of the cloth.

Let-off motions with integrally proportional behavior are more advantageous than that described immediately above. In such let-off motions now being described, the change in warp tension is transferred to the inputs of parallelly arranged proportional and integration elements their common totalling outputs being connected to the control element of the power-let-off unit. Such common totalling output increases or decreases, as required, the speed of warp thread let-off, while the integration element ensures the maintenance of such set-up rate of let-off speed and the return of the detector, i.e., the back-rest, into its original position.

In a known embodiment, this is carried out in such manner that the detector output is connected through a lever transmission with the disc of the integration element, which is mounted slidably and non-rotatably on a rotary shaft between two clutch discs. The clutch discs are arranged for positive rotation in opposite directions, while an extension of the rotary shaft is provided with a thread upon which an internally threaded output element of the integration element is threadedly engaged. Such output element is mounted for axial movement with respect to the shaft while being held from rotation. The output element of the integration element is connected to the input of the proportional element of the let-off motion. Through the second arm of the lever transmission, the detector is connected with the motion screw of the proportional element, on which there is not-rotatably arranged a motion nut. The motion screw is at the same time the output of the proportional element and is, together with the output of the integration element, connected with the control element of the driven let-off motion unit. The principal disadvantage of such embodiment is the considerable complication of its design and its manufacture; such known embodiment also experiences operational breakdowns.

The disadvantages and shortcomings of the above-described prior let-off motions are, to a considerable degree, eliminated by the let-off motion according to the present invention. Such let-off motion comprises a tension detector connected to the input of a let-off element, the output of which is connected with the control element of the driven let-off unit, with the input shaft of the drive and output shaft of the let-off drive, which responds to changes of the control magnitude value in its control element by a change of the relation of angular velocities between the input and output shafts. The input of the let-off element is a rotary disc movably arranged between two axially arranged clutch discs of the let-off element, the clutch discs being mutually forcibly rotatable in opposite directions. The clutch discs of the let-off element are drive-coupled with the input shaft of the driven let-off unit, and the disc of the let-off element is provided with a central, internally threaded hole which receives and is threadedly mated with the threads on the spindle of the let-off element. The spindle is mounted slidably but non-rotatably in the body of the let-off element, and creates the output of the let-off motion let-off element.

One advantageous feature of the invention is that the faces of the disc of the let-off element which selectively engage oneor the other of the clutch discs of the let-off element are mutually axially adjustable.

Another advantageous feature of the invention is that the axis of rotation of the clutch discs of the let-off element is parallel with the input shaft of the driven let-off unit, while the clutch discs are provided with sprockets. On the input shaft there is a driving sprocket connected by a driving chain with the sprocket of one of the clutch discs, while the other sprocket of the second clutch disc is drivingly connected by another chain with another sprocket mounted rotatably on a fixed part of the loom. The two driving sprockets are non-rotatably connected to each other, one of said sprockets engaging its respective chain on one side, while the other of said sprockets engages the other chain on its other side. As a result, the two sprockets, which are connected to the respective clutch discs, are driven in opposite directions.

The driving sprocket on the input shaft of the driven let-off unit is connected to the input shaft by a frictional clutch, the torque at which slipping occurs in the drive through the clutch being adjustable. Such friction clutch thus constitutes a desirable safety device which prevents damage to the parts of the loom which might otherwise occur if the driving sprocket were fixedly mounted upon the input shaft of the driven let-off unit.

The main advantage of the let-off motion according to the present invention as compared with known embodiments is its relatively simple design, its ease of production and assembly, and its considerable operational reliability. At the same time, all of the other advantages of integrally proportional let-off motions are retained.

The invention will be more readily understood upon consideration of the accompanying drawings, in which.

Figure 4:
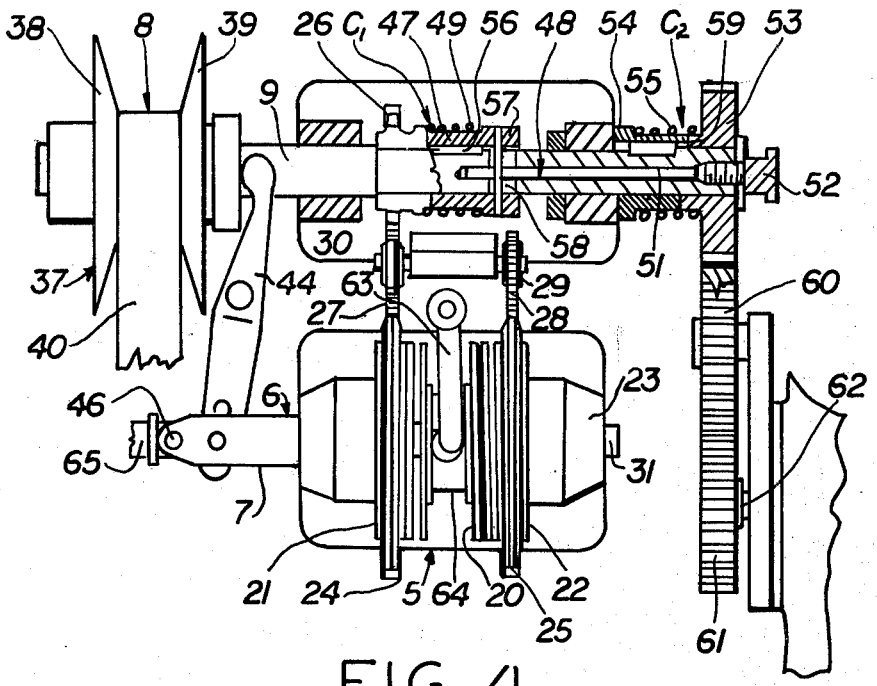
Figure 5:
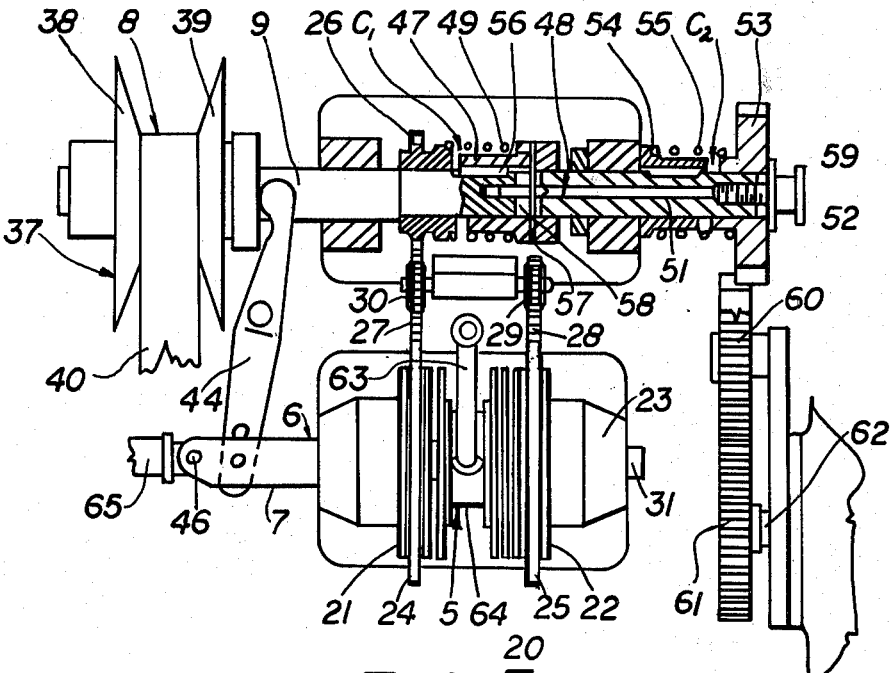

FIG. 4 is a fragmentary view partially in vertical section and partially in side elevation of a second embodiment of the constant tension warp thread let-off motion in accordance with the invention, such figure showing the parts thereof in the positions they assume during operation of the loom; and FIG. 5 is a view similar to FIG. 4 but with the drive to the let-off element shown in the process of being disconnected, so as to allow the warp beam to be turned manually.

Figure 1:
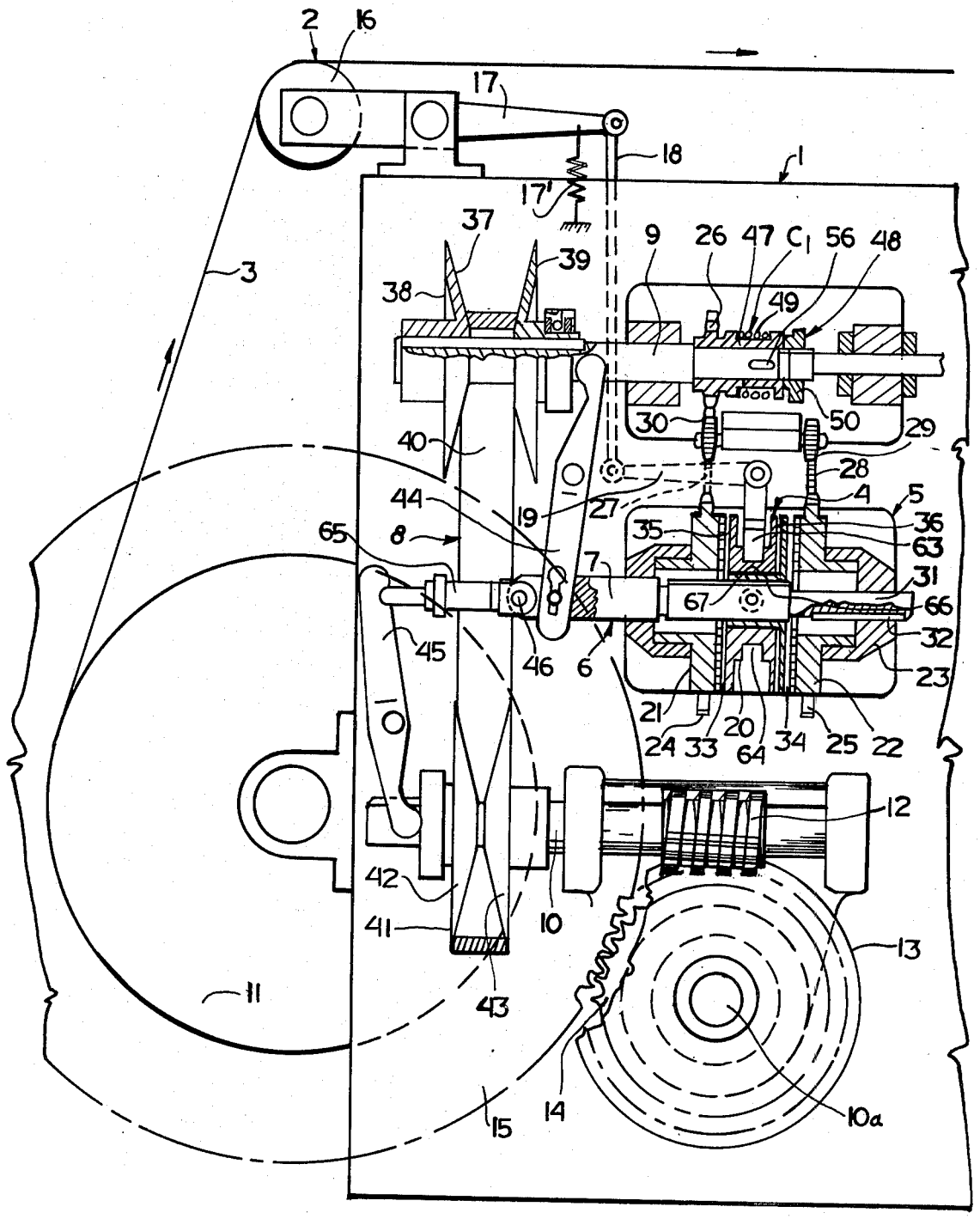
FIG. 1 is a part schematic view, partially in elevation, and partially in vertical section, of a part of a loom provided with a first embodiment of the constant tension warp thread let-off motion of the present invention.
Figure 2:
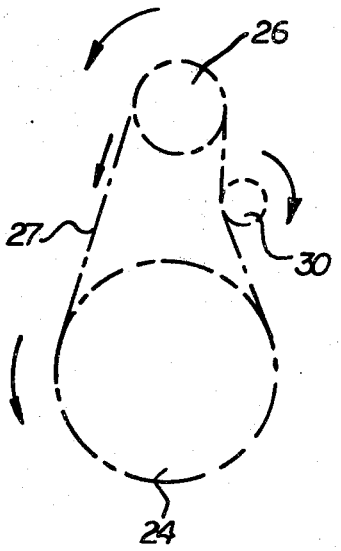
FIG. 2 is a diagram illustrating the chain drive of a first clutch disc of the let-off element of FIG. 1.
Figure 3:
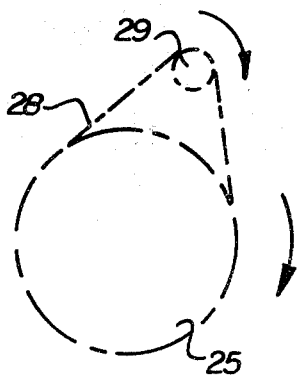
FIG. 3 is a view similar to FIG. 2 of the chain drive of the second clutch disc of the let-off element of FIG. 1.

Turning first to the embodiment of FIGS. 1, 2, and 3, the whole equipment is there shown as being mounted on the frame 1 of the loom. The let-off motion contains, first of all, a detector 2 of the tension in warp threads 3, detector 2 responding to a change in warp thread tension by a change of its position. The tension detector 2 includes a back-rest roll 16 which is rotatably mounted upon one end of a first-class lever, the other part 17 of such lever is connected by a tie rod 18 through a bell crank lever 19 to the input assembly 4 of the let-off element 5. The output 6 of the let-off element 5 is connected in a manner to be described through control element 7 with the power driven let-off unit 8.

The counter-clockwise torque imposed upon the lever upon which the back-rest roll 16 is journalled is opposed by a spring 17' the effective force of which may be adjusted in a known manner. It will be apparent from the above that a change of tension in the warp threads 3 causes the input assembly 4 of the let-off element 5 to be moved axially in one direction or the other, depending upon whether the tension in warp threads 3 has increased or decreased. Input assembly 4 is in the form of a disc 20 consisting of parts 35, 36 screwed together, such parts being provided with faces 33 and 34, respectively.

An input shaft 9, which is connected to be driven by the main shaft (not shown) of the loom in synchronization therewith, is fixedly connected to the upper pulley 37 of the PIV unit 8. Shaft 9 may be driven, for example, in a manner similar to that shown in FIGS. 4 and 5, wherein a driving shaft 62 drives the shaft 9 through the medium of a train of gears 61, 60, and 53. The PIV unit 8 has a lower pulley 41 which is fixedly connected to an output shaft 10. Shaft 10 is drivingly connected to the warp beam 11 through the medium of a worm 12 fixedly mounted upon shaft 10, a worm wheel 13 which meshes with the worm 12, worm wheel 13 being mounted upon a shaft 10*a*. Fixedly connected to the worm wheel 13 to rotate therewith is a gear 14 which meshes with a larger gear 15 affixed to the shaft and drum of the warp beam 11.

In the PIV unit 8, which is conventional, the upper pulley 37 is composed of confronting discs 38, 39, and the lower pulley 41 is composed of confronting discs 42, 43. A V-belt 40 is entrained over the pulleys 37 and 41, the axially movable disc 39 of the upper pulley 37 and the axially movable disc 42 of the lower pulley 41 being controlled so that as the distance between the discs 38, 39 of pulley 37 increases, the distance between the discs 42, 43 of the pulley 41 decreases, and vice versa. In the embodiment shown, the connection between the upper movable disc 39 and the lower movable disc 42 is constituted by an upper first-class lever 44, the upper end of which engages a hub on the disc 39, and the lower end of which is pivotably connected to the output end 7 of the control element 6 of let-off element 5. the hub which is attached to the disc 42 of the lower pulley 41 is engaged by the lower end of a first-class lever 45, the upper arm of which is engaged by a plunger 65 pivotably connected to the output 6 of control element 7 at a pivotal joint 46.

The input 4 of the let-off element 5 is in the form of a rotary disc 20. Disc 20 is movably arranged on a spindle 31 between two coaxially arranged clutch discs 21, 22 of the let-off element 5. Clutch discs 21, 22 are arranged mutually forcibly rotatably on the body 23 of the let-off element 5. The pair of clutch discs 21, 22 is drivingly connected with the input shaft 9 of the power driven let-off PIV unit 8.

In the embodiment of FIGS. 1, 2 and 3, the driving of the clutch discs 21, 22 is effected as follows:

The axis of spindle 31, upon which the discs 21, 22 are mounted, is parallel with the input shaft 9 of the PIV unit 8. The clutch discs 21, 22 are integrally connected, respectively, with sprockets 24 and 25. Mounted upon the input shaft 9 there is a driving sprocket 26 which is drivingly connected with the sprocket 24 through a driving roller chain 27 as shown in FIG. 2. In its passage from the sprocket 24 to the sprocket 26, the chain 27 meshes with the right-hand side (FIG. 2) of the idle sprocket 30. Sprocket 30 is affixed to one end of a shaft journalled in a part of the frame 1, a similar sprocket 29 being affixed to the other end of such shaft. Sprocket 29 is drivingly connected to the sprocket 25 by a chain 28, as shown in FIG. 3. It will be apparent that the sprocket 26 drives the clutch discs 21, 22 in opposite directions by reason of the above-described chain drives to the respective sprockets 24 and 25. Due to the opposite directions of rotation of the clutch discs 21 and 22, the disc 20 rotates in one or the other direction depending on the one of the clutch discs 21 and 22 with which it is in contact; consequently the spindle 31 moves axially either to the left or to the right, and this motion is transferred through the levers 44 and 45 to the slidable discs 39 and 42, respectively.

The input member 4 of the let-off element 5, that is, the disc 20, has a central annular groove 54 therein which is engaged by a yoke 63 on the lower end of the vertical arm of the bell crank lever 19. Disc 20 is provided with an internally threaded axial opening therethrough, the disc 20 being rotatably mounted on the threaded spindle 31 with the threads 66 on the disc 20 and the spindle 31 in mesh. Spindle 31 is held from rotation with respect to the body 23 of the let-off element 5 by a key 32, the spindle 31 and the disc 20 thereon being free for movement axially of the spindle with respect to the body 23.

In order to provide for the adjustment of the clearances or space between faces 33 and 34 of the disc 20 and the confronting faces of the clutch discs 21 and 22, provision is made for the adjustment of the axial distance between faces 33 and 34 of the disc. In the construction shown, the disc 20 consists of two parts 35 and 36, having an axially directed sleeve which carries the internal threading of the disc 20, and the part 35 being internally axially threaded and mounted upon external threads 67 on the sleeve of the clutch part 36. Thus the two clutch parts 35 and 36 can be screwed one into the other and locked by suitable means to adjust the distance between the faces 33, 34 of the disc 20, so that when disc 20 lies in a central, neutral position clearance exists between faces thereon and the confronting faces of the clutch discs 21 and 22.

As pointed out above, a friction slip clutch $C_1$ is provided between the input shaft 9 and the sprocket 26 which drives the let-off element 5. Clutch $C_1$ is made up of a sleeve 47 which is mounted upon the shaft 9 for axial movement with respect thereto but which is held from rotation with respect to the shaft by a key 56. The left-hand end of the sleeve 47 constitutes a friction face which engages the right-hand end of the hub of the driving sprocket 26. The force of engagement between sleeve 47 and the hub of sprocket 26 is determined by the adjusted position of a securing element, generally designated 48, which is constituted by a nut 50 screwed upon a portion of the shaft 9 and engaging the right-hand end of the sleeve 47. Nut 50 may also be employed effectively to disengage the drive between shaft 9 and sprocket 26 by loosening the nut 48, whereupon a coil compression spring 49, interposed between flanges on the hub of the sprocket 26 and a flange at the right-hand end of the sleeve 47, forces the left-hand end of sleeve 47 from driving engagement with the hub of the sprocket 26.

A second embodiment of the constant tension let-off motion in accordance with the invention is shown in FIGS. 4 and 5, wherein parts similar to those shown in FIGS. 1, 2, and 3 are designated by the same reference characters. In such second embodiment, there is provided not only a clutch $C_1$ which selectively disconnects the driving sprocket 26 from the clutch discs 21 and 22, but also a second clutch $C_2$, which is manually operated so as selectively to connect the input shaft 9 of the PIV unit 8 with the driving shaft 62 of the loom, as shown in FIG. 4, or disconnects the shaft 62 from the shaft 9, as shown in FIG. 5.

In the embodiment of FIGS. 4 and 5, the securing element 48 of the first embodiment is replaced by a tie rod 51 which is slidably located in an axial bore in the shaft 9. The left-handend of the tie rod 51 is connected by means of a cross pin 57 which extends through a diametrically disposed axially extending slot 58 in the shaft 9, the radially outer ends of the pin 57 extending through holes in the right-hand end of the sleeve 47. The right-hand end of the tie rod 51 is rotatably connected to a thumb screw 52, the axially inner end of the thumb screw having a threaded connection with the right-hand end of the shaft 9, tie rod 51 and thumb screw 52 being prevented from relative axial movement with respect to each other. It will be apparent that the screwing of member 52 in the appropriate direction will result in the travel to the right of the tie rod 51 with respect to the shaft 9, thereby to disconnect the clutch $C_1$ as shown in FIG. 5.

Such operation also results in the opening of disconnecting of the clutch $C_2$, likewise as shown in FIG. 5. The clutch $C_2$ is made up of a sleeve 54 which is keyed to the shaft 9 for rotation therewith. When the parts of the clutch $C_2$ are in the position of FIG. 4, the right-hand end surfaces of sleeve 54 strongly drivingly engages the left-hand end surface of the hub of gear 53. A coil compression spring 55 is disposed between a flange on the right-hand end of the sleeve 54 and the left-hand face of the gear 53. When the thumb screw 52 is turned so as to screw it outwardly of the left-hand end of shaft 9, the coil compression spring 55 thrusts the gear 53 to the right somewhat, but insufficient completely to disengage gear 53 from gear 60. There is thereupon produced a gap between the friction surfaces 59 of the gear 53 and the sleeve 54, so that gear 53 no longer drives the shaft 9. In the position of the part shown in FIG. 5, the warp beam 11 may be turned manually by a hand crank (not shown) without affecting the adjustment of the let-off element 5.

The warp thread let-off of the invention functions as follows during the operation of the loom. Warp threads 3 are continuously let-off from the warp beam 11; if there is no disproportion between the speed of the warp 3 let-off and the speed of the take-up on a cloth beam (now shown), the detector 2 including the back-rest cylinder 16 remain in their predetermined set-off positions and the angular velocity of the output shaft 10 of the driven PIV let-off unit 8 is constant, since the output 6 of the let-off element 5 is at rest. In case of a change in tension in the warp threads 3, the detector 2 changes its position. This change is transferred through lever 17, tie rod 18 and bell crank lever 19 to the rotary disc 20 which is then moved axially to come into contact with one of the clutch discs 21, 22. The result is a change in the value of the control magnitude, that is, a change in the position of spindle 31, which is connected with control element 7; this causes a change in the position of the slidable discs 39 and 42 of pulleys 37, 41 of the PIV unit 8, and thus a change of the angular velocity of the output shaft 10 and thus also a change in the angular velocity of the warp beam 11. After equalizing the tension of the warp threads 3, the thus changed angular velocity of the output shaft 10 of the power-let-off unit 8 is maintained, but the back-rest cylinder 16 returns due to the action of spring 17 or due to the tension of the warp threads 3, as the case may be into the original set-up position until there is a further change in the tension of the warp threads 3, when the whole process is repeated. The let-off motion has therefore a proportionally integrational behavior.

The device of the invention can be advantageously used where a wound-up flexible material is to be let-off under constant tension.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A constant tension let-off motion for the positive let-off under tension of flexible material from a package thereof wound upon a let-off beam, comprising a variable drive unit having a control, a driven input shaft, and an output shaft, means positively drivingly connecting the output shaft of the variable drive unit to the let-off beam, the flexible material being advanced under tension to a second, take-up beam, a material tension detector having a movable part coacting with the material extending between the two beams, the movable part of such tension detector responding to a change of tension in the material by a change of its position, a let-off control connected to the control of the variable drive unit, the let-off control including a let-off element comprising two axially spaced clutch discs which are driven in opposite directions, a control disc disposed between the two clutch discs coaxially thereof, the clutch discs and the control disc being mounted upon a supporting shaft, means connecting the movable part of the tension detector to the control disc of the let-off element whereby the tension detector selectively moves the control disc axially into driving contact with one or the other of the clutch discs, the control disc having a threaded connection to a sleeve which is mounted for movement along the shaft which supports the clutch discs and of the control disc while such shaft is held from rotation, said supporting shaft being the output of the let-off element.

2. A left-off motion according to claim 1, wherein the control disc of the let-off element is formed of two parts which are axially adjustable relative to each other, whereby to adjust the clearance between the opposite faces of the control disc and the respective confronting driven clutch discs.

3. A let-off motion according to claim 1, wherein the axis of rotation of the clutch discs of the let-off element is parallel with the driven input shaft of the variable drive unit, and the clutch discs are provided with chain drives from said input shaft.

4. A let-off motion according to claim 3, wherein the drive means for one of the clutch discs comprises a first, driving sprocket on the input drive shaft for the variable drive unit, a second sprocket aligned with the first sprocket and fastened to a first one of the clutch discs to rotate therewith, and a first drive chain between the first and second sprockets, and the means for driving the other clutch disc comprises a third sprocket fixed to the shaft on which the second sprocket is mounted, a fourth sprocket fixed to the other, second clutch disc to rotate therewith, and a second chain entrained over the third and fourth sprockets, the third sprocket engaging the first chain so as to be rotated in a direction which is opposite from the direction of rotation on the first and second sprockets.

5. A let-off motion according to claim 3, comprising a first selectively manually disengageable clutch disposed on the input shaft of the variable drive unit and the first, driving sprocket, whereby the driving sprocket may be disconnected from the input shaft.

6. A let-off motion according to claim 5, wherein said first manually disengageable clutch comprises a connecting sleeve telescoped over the drive shaft of the variable drive unit, the first, driving sprocket being mounted on said drive shaft for free rotation with respect thereto, the first sprocket having an end face confronting and end face of a connecting sleeve, the connecting sleeve being mounted for sliding movement with respect to the driving shaft but being rotatable therewith, means for forcibly thrusting the confronting ends of the sleeve and first sprocket together whereby to drive the first sprocket positively from the drive shaft for the variable drive unit, and a coil compression spring telescoped about the driving shaft and disposed between the first sprocket and the connecting sleeve to force them apart when the means thrusting the connecting sleeve into engagement with the first sprocket is loosened.

7. A let-off motion according to claim 6, wherein the means which thrusts the connecting sleeve against the first sprocket is a nut threaded upon the input drive shaft of the variable drive unit.

8. A let-off motion according to claim 6, wherein the means for forcibly thrusting the confronting ends of the sleeve and first sprocket together is in the form of a tie rod slidably mounted on the input shaft of the variable drive unit, one end of the tie rod being connected with the connecting sleeve with means of a cross pin through a recess in the input shaft, the input shaft has a free end, and the other end of the tie rod is rotatably connected to a thumb screw which is mounted at the free end of the input shaft, said tie rod in one axial position thereof permitting the connecting sleeve drivingly to engage the hub of the driving sprocket, and in another position thereof permitting the connecting sleeve to move out of engagement with the hub of the driving sprocket under the influence of a coil compression spring disposed therebetween.

9. A let-off motion according to claim 8, wherein said tie rod also controls the opening and closing of a second manually controlled clutch which is interposed between the input shaft of the variable drive unit and a driving means for the input shaft of the variable drive unit, said thumb screw simultaneously opening and closing the first and second manually disengageable clutches.

* * * * *